US005231425A

United States Patent [19]

Masuda et al.

[11] Patent Number: 5,231,425

[45] Date of Patent: Jul. 27, 1993

[54] STORAGE CONTAINER

[75] Inventors: Kazuaki Masuda, Sagamihara; Nobuyuki Kuwabara, Tokyo, both of Japan

[73] Assignee: Canon Kabushiki Kaisha, Tokyo, Japan

[21] Appl. No.: 825,771

[22] Filed: Jan. 21, 1992

Related U.S. Application Data

[63] Continuation of Ser. No. 617,252, Nov. 21, 1990, abandoned, which is a continuation of Ser. No. 463,467, Jan. 11, 1990, abandoned.

[30] Foreign Application Priority Data

Jan. 13, 1989 [JP] Japan ..... 1-007473

[51] Int. Cl.[5] ..... B41J 2/175; B41J 29/13; B65D 81/00

[52] U.S. Cl. ..... 346/140 R; 346/146; 206/328

[58] Field of Search ..... 346/140 R, 146; 206/328; 357/72, 74, 80; 361/380, 390, 394, 399

[56] References Cited

U.S. PATENT DOCUMENTS

| | | | |
|---|---|---|---|
| 4,345,262 | 8/1982 | Shirato et al. | 346/140 R |
| 4,600,927 | 7/1986 | Sugitani | 346/1.1 |
| 4,689,642 | 8/1987 | Sugitani | 346/140 R |
| 4,711,350 | 12/1987 | Yen | 206/328 |
| 4,756,414 | 7/1988 | Mott | 206/328 |
| 4,775,871 | 10/1988 | Abe et al. | 346/140 R |

FOREIGN PATENT DOCUMENTS

| | | |
|---|---|---|
| 0342930 | 11/1989 | European Pat. Off. . |
| 2288688 | 10/1974 | France . |
| 2575413 | 12/1985 | France . |
| 61-025844 | 2/1986 | Japan . |
| 61-93264 | 6/1986 | Japan . |
| 0019460 | 1/1987 | Japan . |

*Primary Examiner*—Benjamin R. Fuller
*Assistant Examiner*—Alrick Bobb
*Attorney, Agent, or Firm*—Fitzpatrick, Cella, Harper & Scinto

[57] ABSTRACT

There is disclosed a storage container for an ink jet recording head, consisting of a part having a box-shaped recess for housing the recording head, and another plate-shaped part for covering the aperture of the recessed part. The recessed part and/or the plate-shaped part has volume resistivity not exceeding $10^{10}$ Ω.cm at least in a portion in contact with the ink jet recording head, and is transparent totally or in part, and both members have nitrogen permeability not exceeding 0.5 cc.mm/cm$^2$sec.cmHg.$10^{10}$. The container serves to prevent solidification of ink and electrostatic destruction during storage of the recording head.

12 Claims, 4 Drawing Sheets

STORAGE CONTAINER

This application is a continuation of application Ser. No. 07/617,252 filed Nov. 21, 1990 which is a continuation of Ser. No. 07/463,467 filed Jan. 11, 1990, both now abandoned.

BACKGROUND OF THE INVENTION

1. Field of the Invention

The present invention relates to a storage container adapted for use in an ink jet head for forming a record by discharging liquid thereby forming a flying liquid droplet, and more particularly to a storage container adapted for delivery to general users in the commercial systems of replaceable and disposable ink jet head.

2. Related Background Art

As is already well known, in ink jet recording, a flying liquid droplet is formed discharging liquid ink from an orifice of an ink jet recording head and to deposit said droplet onto a recording sheet, thereby recording various characters and patterns by the group of thus formed ink dots.

From the standpoint of maintenance of ink jet recording, the ink employed in ink jet recording is composed of a small amount of dye dissolved in water, with the addition of a water-miscible organic solvent such as alcohol, if necessary. Usually water represents the highest proportion in the composition. Consequently, if the ink jet recording head is left unused for a prolonged period, evaporation of water from the ink takes place from the discharge port of said head, thereby elevating the dye concentration in the ink and eventually causing solid deposition of the dye after a long period, whereby the discharge port is blocked and becomes incapable of ink discharge. This phenomenon has been pointed out as a weak point of the ink jet recording.

In order to overcome this drawback, there has been proposed a disposable ink jet recording head which is mounted on the printer and is replaced by a new one when the ink is used up or the ink discharge becomes impossible. However, even in such a type of the head, there can still occur the same drawback in the course of storage as merchandise.

On the other hand, such an ink jet recording head usually has 10 to 256 discharge ports, but such discharge ports are preferably present in a higher density and in a larger number, in order to achieve a higher printing speed and/or a higher print quality. However an increase in the number of the discharge ports will lead to an increase in the number of electric wirings for driving the ink jet recording head, or in the number of electrical contacts between the ink jet recording head and the printer. For example, a head with 48 discharge ports requires 96 contacts in total, namely two for each discharge port. It is extremely difficult technically to connect a large number of electrical contacts with sufficient reliability, simultaneous with the mounting of the ink jet recording head on the printer. On the other hand, the use of an ordinary connector, if employed for securing reliability, is impractical because of the bulkiness of the connecting part.

It is already known to incorporate a part of the drive system in the ink jet recording head, in order to reduce the number of such electrical contacts. More specifically, the reduction in the number of electrical contacts is being done by incorporating a shift register, a transistor array or a diode array in the recording head. Such an ink jet recording head incorporating semiconductor components has to have sufficient measures against electrostatic charges to which such components are susceptible.

In order to achieve prevention of such ink solidification and electrostatic destruction, there has been adopted a method of placing the ink jet recording head in a molded aluminum container and adhering an aluminum cover sheet to said container. However, such packaging method is not inexpensive. Besides, since the packaged merchandise cannot be identified from the outside at the time of purchase, the user may break the seal to confirm the contents.

On the other hand, a so-called blister package often used for example for stationery goods may not be adequeate in terms of prevention of ink solidification and of electrostatic charge.

SUMMARY OF THE INVENTION

An object of the present invention is to provide a storage container not associated with the above-mentioned drawbacks.

More specifically, the object of the present invention is to provide a storage container capable of satisfactorily preventing the ink solidification and the electrostatic damages required for the storage of the ink jet recording head.

Another object of the present invention is to provide a storage container capable of enabling prolonged storage under various conditions, particularly under a high temperature in the course of delivery from the manufacturer to the user and until the actual use by the user, and also providing sufficient safety against electrostatic destruction.

Still another object of the present invention is to provide a storage container of a low cost, enabling confirmation of the interior thereof.

DESCRIPTION OF THE PREFERRED EMBODIMENTS

Figure 1:
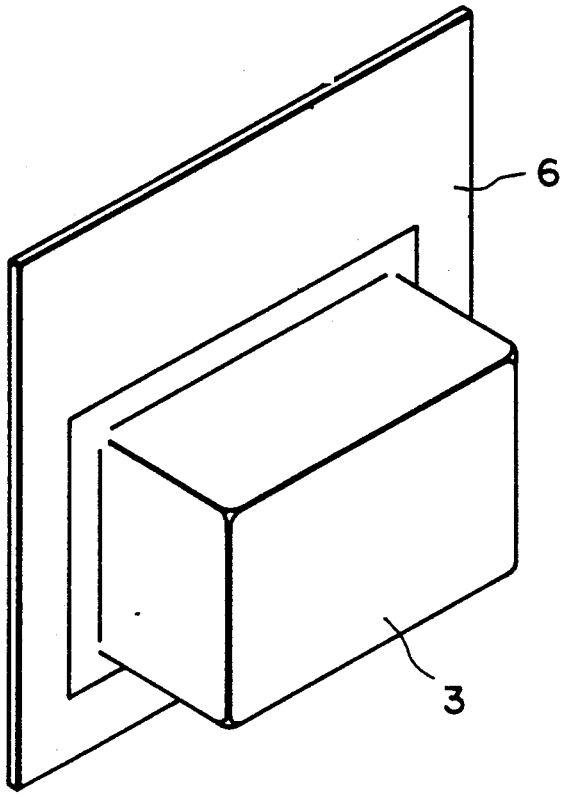
FIG. 1 is a schematic external view of a storage container of the present invention.

The foregoing objects are attained, according to the present invention, by a storage container for the ink jet recording head, composed of a member having a recessed portion for accommodating the ink jet recording head and a plate-shaped member adherable thereto, wherein either or both of said members are composed of a material with a volume resistivity (or solid inherent resistance) not exceeding $10^{10}$ Ω.cm at least in a portion thereof in contact with the ink jet recording head, either or both of said members are transparent or partially transparent and both members have permeability to nitrogen not exceeding 0.5 cc.mm/cm$^2$.sec.cm$^2$Hg.$10^{10}$ at 25° to 30° C. The storage container of the present invention composed of the material of the above-mentioned physical properties can prevent solidification of ink, can effectively protect the ink jet recording head from electrostatic destruction and enables confirmation of its contents.

The recessed member and the plate-shaped member constituting the storage container of the present invention may be composed of a single material, or a multi-layered structure of different materials. In either case, either or both of said members have to be composed of a material of a volume resistivity not exceeding $10^{10}$ Ω.cm at least in a portion thereof in contact with the ink jet recording head, namely the internal wall of the storage container. This is because an insulating material with volume resistivity exceeding $10^{10}$ Ω.cm tends to generate electrostatic charge by friction, contact, peeling or corona discharge.

With respect to the gas permeability of said members, the present inventors proved that the solidification of ink by drying can be prevented if both members have nitrogen permeability not exceeding 0.01 cc.mm/cm$^2$.sec.cmHg.$10^{10}$, preferably not exceeding 0.2 cc.mm/cm$^2$.sec.cmHg.$10^{10}$. Such requirement can be satisfied for example by the use of vinylidene chloride, polyamide, polyethylene terephthalate or chlorinated rubber.

The gas barrier property can be improved, even if the permeability of the main component exceeds 0.2 cc.mm/cm$^2$.sec.cmHg.$10^{10}$, by dispersing fine solid particles such as calcium powder when the member is composed of a single layer, or vacuum evaporating a layer of metal such as aluminum or copper or laminating a foil of such metal when the member is composed of plural layers.

The thickness of the members of the storage container should be in a range from 0.01 to 10 mm in consideration of mechanical strength and molding property, preferably 0.01 to 5 mm, and most preferably 0.1 to 2 mm. Said thickness may be suitably selected within the above-mentioned range in consideration of the material employed and the form of the container, and two members may have same or different thicknesses.

In a more preferred embodiment, either or both of the members of the storage container are provided with projecting parts on the internal wall thereof, thereby the discharge ports of the ink jet recording head can be prevented from damage by contact with the internal wall of the storage container, or ink leakage, even in case the storage container, containing the ink jet recording head, is dropped or subjected to vibration.

In order to enable confirmation of the ink jet recording head in the storage container without breaking the seal, at least one of the members has to be transparent or transparent in part. Such transparency in part can be obtained, for example if the plate-shaped member is composed of plural layers, by employing a transparent layer and another opaque layer which is cut out corresponding to the recessed portion.

The storage container of the present invention is not limited to the structures or form explained above or to be explained later, but is subject to various modifications within the scope and spirit of the appended claims.

Now the storage container of the present invention will be explained in more detail by examples, which are designed for an ink jet recording head of a dimension of 20×30×50 mm as schematically illustrated in a perspective view in FIG. 6.

Figure 6:
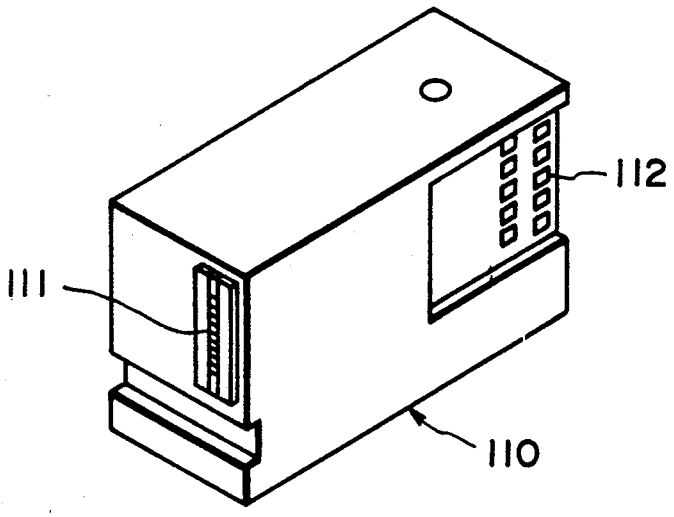
FIG. 6 is a perspective view of a representative ink jet recording head.

Referring to FIG. 6, the ink jet recording head 110 is provided with discharge ports 111, and electrical terminals 112 for supplying electrical energy to energy generating elements (heat generating elements or piezoelectric elements) for discharging ink from the discharge ports.

Though not shown in FIG. 6, the ink jet recording head 110 is further provided with an ink tank for storing ink to be discharged from the discharge ports 111.

FIG. 1 is a schematic external view showing the basic structure of the storage container for the ink jet recording head, of the present invention.

The storage container shown in FIG. 1 comprises a recessed member 3 molded as a box-shaped container and having an adhesion face 2 at the upper edge thereof, and a plate-shaped member 6 to be adhered to said adhesion plane 2 for closing the aperture of said recessed member 3.

Figure 2:
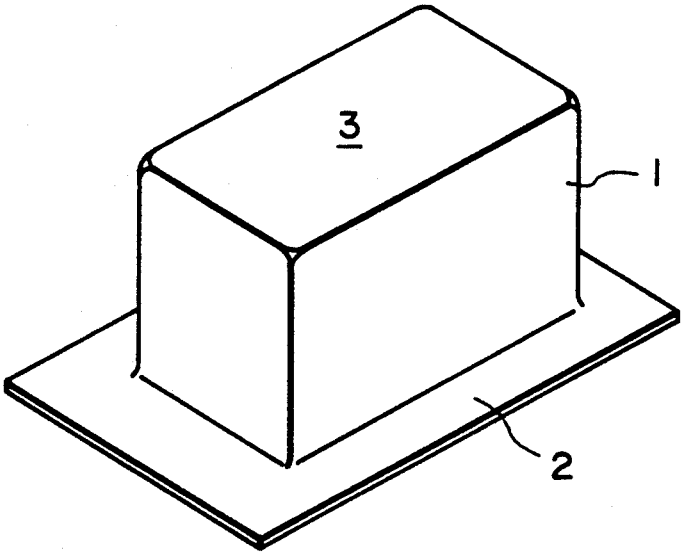
FIG. 2 is a schematic view of a member with recess.
Figure 3:
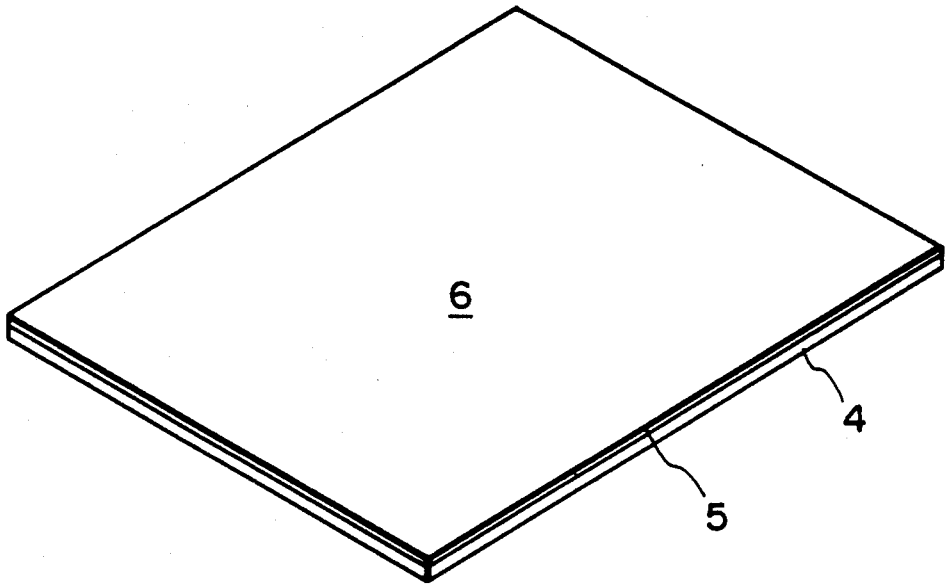
FIGS. 3 and 4 are schematic views of a plate-shaped member.

FIG. 2 shows the recessed member alone in a schematic perspective view, and FIG. 3 shows the plate-shaped member 6 alone in a shematic perspective view.

The recessed members and the plate-shaped members shown in FIGS. 1 to 3 were prepared and subjected to a storage test and an electrostatic destruction test in the following manner, with the ink jet recording head shown in FIG. 6 sealed therein.

EXAMPLE 1

As the recessed member of accommodating the ink jet recording head, a transparent sheet of a thickness of 0.5 mm of thermoplastic acrylonitrile resin (Zacron supplied by Sohio Chemical Corp.) was formed as shown in FIG. 1 by deep drawing so as to have a recess 1 of an area of 35×55 mm and a depth of 25 mm, and an adhesion area 2 of a width of 10 mm, with an overall thickness of 0.4 mm.

The plate-shaped member 6 was composed, as shown in FIG. 3, of cardboard 4 of a thickness of 0.5 mm on which an aluminum foil of a thickness of 0.1 mm was adhered and which was cut into a size of 85×85 mm.

Both members were adhered, after putting the ink jet recording head therein, with an epoxy adhesive HP2R/2H (supplied by Canon Chemical Co.) which was hardened for 24 hours at room temperature.

EXAMPLE 2

The recessed member for accommodating the ink jet recording head was composed of an aluminum plate of a thickness of 0.1 mm, deep drawn in the same form as in the Example 1.

The plate-shaped member was composed of a transparent Zacron sheet of a thickness of 0.5 mm, cut into a size of 85×85 mm.

These two members were adhered, after putting the ink jet recording head therein, with an epoxy adhesive HP2R/2H (supplied by Canon Chemical Co.), which was hardened for 24 hours at room temperature.

EXAMPLE 3

The recessed member for accommodating the ink jet recording head was composed of an aluminum plate of a thickness of 0.1 mm, deep drawn in the same form as in the Example 1.

Figure 4:
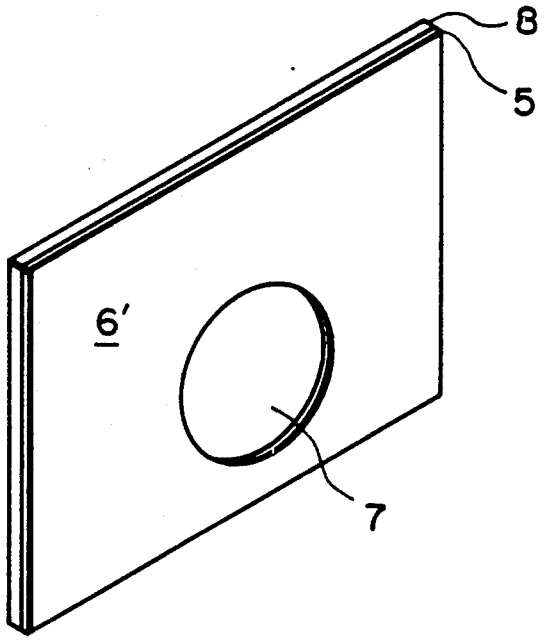

The plate-shaped member 3' was composed, as shown in FIG. 4, of a transparent Zacron sheet 8 of a thickness of 0.5 mm, which was cut into a size of 85×85 mm and on which adhered was an aluminum foil 5 of a thickness of 0.1 mm with a circular hole of a diameter of 40 mm.

Figure 5:
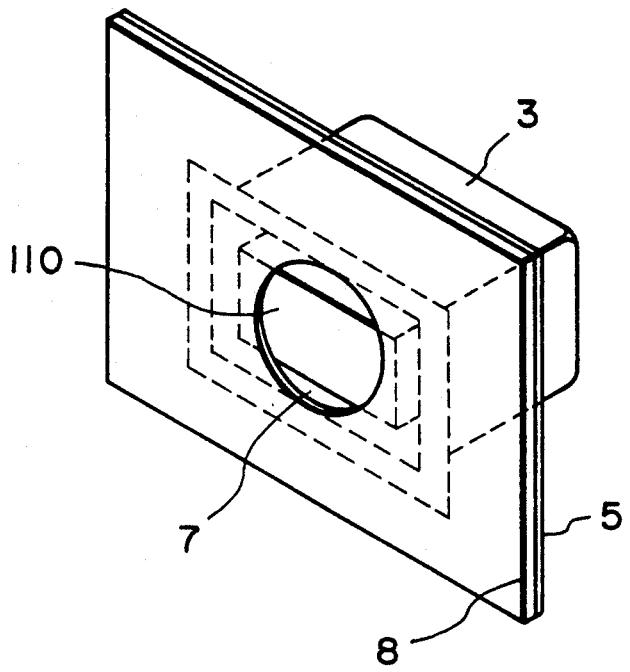
FIG. 5 is a schematic view of a storage container employing the plate-shaped member shown in FIG. 4.

These two members were adhered as shown in FIG. 5, after putting the ink jet recording head therein, with an epoxy adhesive HP2R/2H (supplied by Canon Chemical Co.), which was hardened for 24 hours at room temperature.

EXAMPLE 4

A recessed member for accommodating the ink jet recording head was formed by deep drawing a transparent sheet of a thickness of 0.5 mm of thermoplastic acrylonitrile resin (Zacron supplied by Sohio Chemical Corp.) to obtain a molded article with a thickness of 0.4 mm, a recess of an area of 35×55 mm and a depth of 25 mm and an adhesion area of a width of 10 mm.

The plate-shaped member was composed of a transparent Zacron sheet of a thickness of 0.5 mm, cut into a size of 85×85 mm.

Both members were immersed in solution of transparent antistatic paint (Skytough T supplied by Achiles Co.), then dried by standing for 3 hours, and adhered in the same manner as in the Example 1.

The Skytough T paint employed herein is transparent, so that the transparency was not altered by dip coating. The coating had a thickness of about 2 μm, and a volume resistivity of about $1\times10^{10}$ Ω.cm.

EXAMPLES 5, 6; REFERENCE EXAMPLES 1-3

Storage containers were prepared with the materials shown in Tab. 1, with the same methods as in the Examples 1-4.

Both members were prepared with Zacron as in the Example 4, and coated with Skytough T by spraying instead of dipping. The coating had a thickness of ca. 2 μm and a volume resistivity of ca. $1\times10^{11}$ Ω.cm.

The containers obtained in the foregoing examples and reference examples were subjected to following tests, of which results are summarized in Tab. 1.

Storage Stability Test

Containers in which the ink jet recording heads were sealed were placed in a dry oven of 60° C., and were opened at different times. The ink jet recording head taken out from the container was mounted on a printer and the state of printing was observed. The ink solidification was estimated from the quality of obtained print.

Electrostatic Destruction Test

The container was subjected to a discharge of 15 kV while one of the members constituting the container (conductive one in the Examples, but not specified in the Reference Examples) is grounded. Thereafter the ink jet recording head was taken out from the container and mounted on a printer, and the state of printing was observed.

TABLE 1

| | Material of recessed member | Material of plate shaped member | Storage stability test 1 wk | 1 month | 3 months | 15 kV static destruction test |
|---|---|---|---|---|---|---|
| Example 1 | Zacron | Paper-Al | + | + | + | + |
| Example 2 | Al | Zacron | + | + | + | + |
| Example 3 | Al | Zacron + Al (holed) | + | + | + | + |
| Example 4 | Zacron + Skytough T | Zacron + Skytough T | + | + | + | + |
| Example 5 | Al | Vinylidene | + | + | + | + |
| Example 6 | Zacron + Skytough T | Vinylidene chloride | + | + | + | + |
| Ref. Ex. 1 | Vinyl chloride | Zacron | + | − | − | − |
| Ref. Ex. 2 | Vinyl chloride | Paper-Al | + | − | − | − |
| Ref. Ex. 3 | Al | Vinyl chloride | + | − | − | − |
| Ref. Ex. 4 | Zacron + Skytough T | Zacron + Skytough T | + | + | + | − |

+ Good (no change)
− Poor

As will be apparent from Tab. 1, the containers of the Examples showed satisfactory results in both tests. On the other hand, the containers employing polyvinyl chloride as in the Reference Examples 1 to 3 showed poor stability after 1 month, exhibiting ink deposition at the front end portion of the discharge ports of the ink jet recording head. Also the container showing the volume resistivity higher than $1\times10^{11}$ Ω.cm, as in the Reference Example 4, did not have enough durability against electrostatic destruction.

EXAMPLE 7

Figure 7:
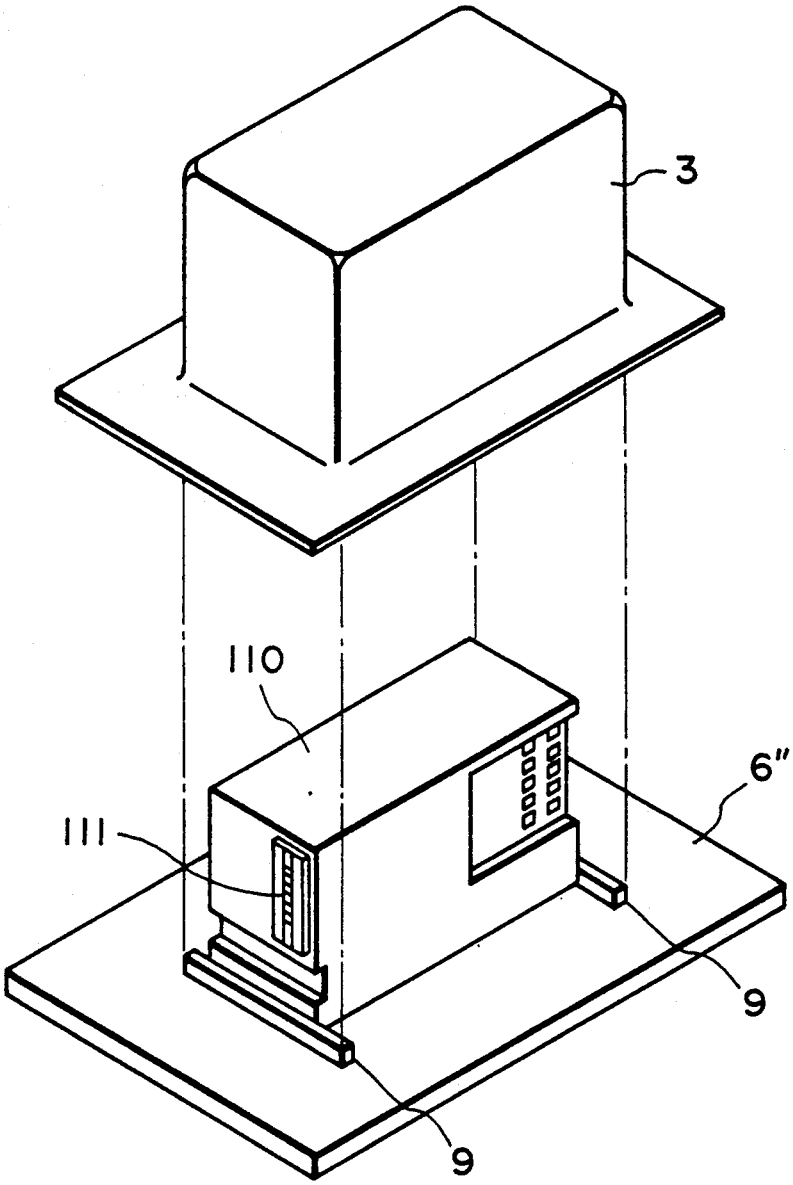
FIG. 7 is a schematic view of a plate-shaped member with projections on which an ink jet recording head is fixed.

The plate-shaped member in the Example 2 was modified as a member 6″ shown in FIG. 7, with projections 9.

As shown in an exploded view in FIG. 7, projections 9 were so provided as to engage with the recess of the recessed member 3, and said recessed member 3 and the member 6″ was adhered in the same manner as explained before. Said projections may be formed separately or integrally.

Such structure supressed the movement of the ink jet recording head in the container even when it was subjected to an external force such as dropping or vibration, and protected the discharge ports 111 of the head 110 from contacting the internal wall of the container, thereby preventing damage to the discharge ports or ink leakage.

Naturally the container of the present embodiment showed excellent storage capability and resistance to electrostatic destruction as in other embodiments.

As explained in the foregoing, the storage container of the present invention for the ink jet recording head enables prolonged storage under various circumferential conditions, particularly under high temperature, in the course of delivery from the manufacturer to the user, and provides considerable safety against unpredictable electrostatic destruction, thereby improving the reliability of the recording head. It is also rendered possible to provide an inexpensive storage container with inexpensive materials, allowing to confirm the content of the container.

The storage container of the present invention is usable not only for the ink jet recording head with the ink tank as explained above, but also for the ink jet recording head only.

We claim:

1. A storage container for an ink jet recording head comprising a member provided with a recess for accommodating the ink jet recording head and a plate-shaped member adherable thereto, wherein at least one of said members is composed of a material with a volume resistivity not exceeding $10^{10}$ Ω.cm at least in a portion that can be in contact with the ink jet recording head, at least one of said members is translucent at least in part, at least one of said members includes a rib for contacting an outer housing of the ink jet recording head and preventing the ink jet recording head from contacting the other of said members, and both members have nitrogen permeability not exceeding 0.5 cc.mm/$cm_2$.sec.cmHg.$10^{10}$ at 25° to 30° C.

2. A storage container according to claim 1, wherein at least one of said members has a thickness not less than 0.01 mm and not exceeding 10 mm.

3. A storage container according to claim 1, wherein at least one of said members has projecting parts on an internal wall thereof.

4. An article comprising an ink jet recording head and a storage container therefor, wherein said storage container comprises a member provided with a recess for accommodating said ink jet recording head and a plate-shaped member adherable thereto, wherein at least one of said members is composed of a material with a volume resistivity not exceeding $10^{10}$ Ω.cm at least in a portion that can be in contact with said ink jet recording head, at least one of said members is translucent at least in part, at least one of said members includes a rib for contacting an outer housing of said ink jet recording head and preventing said ink jet recording head from contacting the other of said members, and both members have nitrogen permeability not exceeding 0.5 cc.mm/$cm^2$.sec.cmHg.$10^{10}$ at 25° to 30° C.

5. An article according to claim 4, wherein at least one of said members has a thickness not less than 0.01 mm and not exceeding 10 mm.

6. An article according to claim 4, wherein at least one of said members has projecting parts on an internal wall thereof.

7. An article according to claim 4, wherein said ink jet recording head comprises an element for generating energy for ink discharge.

8. An article according to claim 7, wherein said discharge energy generating element is composed of a heat generating element for generating thermal energy utilized as the energy for ink discharge.

9. An article according to claim 4, wherein said contact is made with electrical contact terminals of the ink jet recording head.

10. A container for containing a recording head, the recording head having an outer frame, a discharge port for discharging ink and an electrical connecting portion through which a recording signal is supplied to discharge ink through said discharge port, said container comprising:

a recess member having a recess portion in which the recording head is received;

a cap member joined to said recess member to close said recess portion; and a rib for supporting the outer frame of the recording head, said rib provided on one of said recess member and said cap member, wherein said rib supports said recording head so that one of said discharge port and said electrical connecting portion is prevented from contacting said recess member and said cap member.

11. A container according to claim 10, wherein at least a part of one of said recess member and said cap member has solid inherent resistance of less than $10^{10}$ Ω.cm.

12. a container according to claim 10, wherein said the nitrogen permeability of said recess member and said cap member at a range of 25°–30° C. is less than 0.5 cc.mm/$cm^2$.sec.cmHg.$10^{10}$.

* * * * *

UNITED STATES PATENT AND TRADEMARK OFFICE

CERTIFICATE OF CORRECTION

PATENT NO. : 5,231,425

DATED : July 27, 1993

INVENTOR(S) : Kazuaki MASUDA, et al.

It is certified that error appears in the above-indentified patent and that said Letters Patent is hereby corrected as shown below:

Title Page:

AT [57] ABSTRACT:

Line 10, "0.5 cc.mm/$cm^2$sec.cmHg.$10^{10}$." should read --0.5 cc.mm/$cm^2$.sec.cmHg.$10^{10}$.--.

COLUMN 6:

Line 36, "was" should read --were--;

Line 52, "circumferen-" should be deleted;

Line 53, "tial" should be deleted.

COLUMN 8:

Line 35, "a" should read --A--; and "said" should be deleted.

Signed and Sealed this

Twentieth Day of September, 1994

*Attest:*

*Attesting Officer*

BRUCE LEHMAN

*Commissioner of Patents and Trademarks*